United States Patent [19]

Krieger

[11] 4,246,830

[45] Jan. 27, 1981

[54] FIRING PIN

[76] Inventor: Robert R. Krieger, 2505 Town Hall, Troy, Mich. 48084

[21] Appl. No.: 914,031

[22] Filed: Jun. 9, 1978

[51] Int. Cl.[3] ..... F41D 11/16

[52] U.S. Cl. ..... 89/179; 89/132; 89/185

[58] Field of Search ..... 42/69 R, 69 A, 69 B; 89/27, 132, 179, 185

[56] References Cited

U.S. PATENT DOCUMENTS

| | | | |
|---|---|---|---|
| 624,145 | 5/1899 | Young | 89/132 |
| 760,085 | 5/1904 | Stockett | 89/27 R |
| 1,795,568 | 3/1931 | McCann | 89/27 R |
| 2,656,636 | 10/1953 | Green | 42/69 A |
| 3,013,355 | 12/1961 | Weatherby | 42/69 A |

FOREIGN PATENT DOCUMENTS

| | | | |
|---|---|---|---|
| 130021 | 7/1919 | United Kingdom | 89/185 |

*Primary Examiner*—Stephen C. Bentley
*Attorney, Agent, or Firm*—Hauke and Patalidis

[57] ABSTRACT

A firing pin for a firearm, more particularly for a firearm provided with a gas-operated bolt and bolt-carrier, the firing pin being disposed slidably in a longitudinal bore in the bolt. The firing pin of the invention has its shoulder abutment, which limits the stroke of the firing pin, provided with longitudinal apertures, such as slots or holes, preferably disposed at an angle to the longitudinal axis of the firing pin, which provide passageways for the pressure gas operating the bolt-carrier and leaking along the stem of the firing pin. Carbon, or other dirt, is thus prevented from being deposited on the firing pin stem, more particularly at the shoulder abutment. The action of the escaping gas through the inclined apertures further causes the firing pin to rotate each time the bolt-carrier is automatically operated during firing of the firearm, and straight grooves or helical grooves may be formed in the firing pin stem proximate the shoulder abutment to further keep clean the firing pin stem peripheral surface and the internal wall of the bore in the bolt.

18 Claims, 20 Drawing Figures

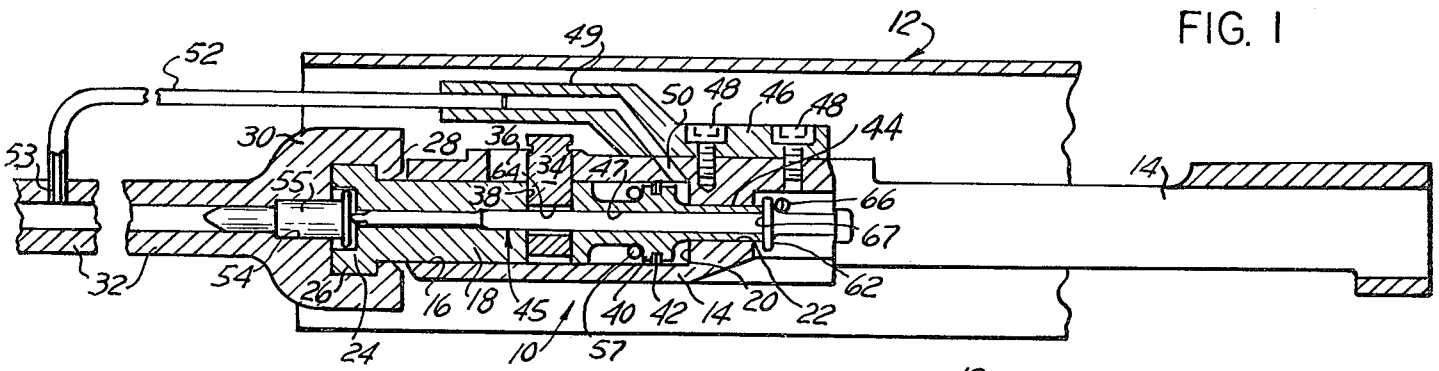
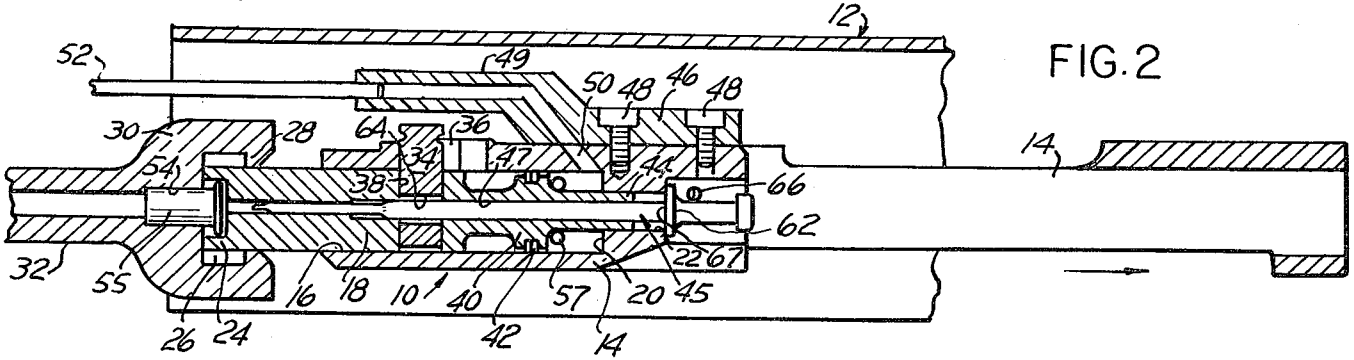
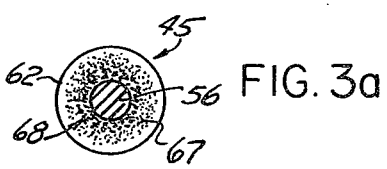
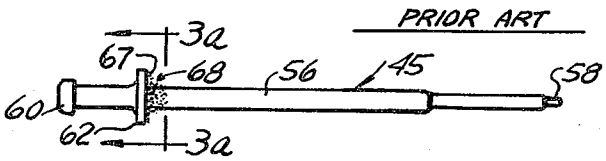
FIG. 3

FIG. 4a
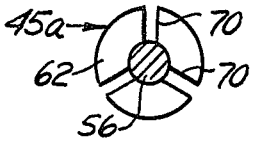
FIG. 4
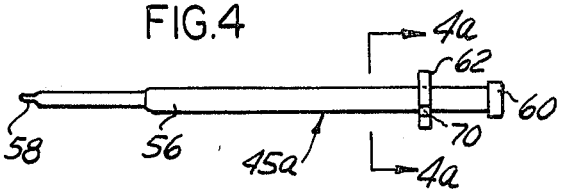
FIG. 5a
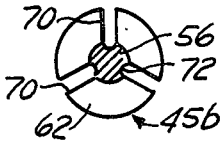
FIG. 5
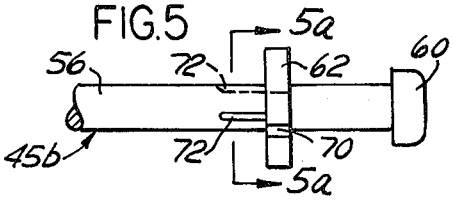
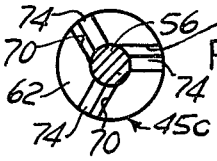
FIG. 6a
FIG. 6
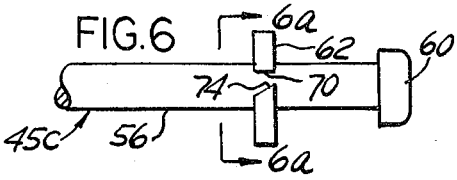
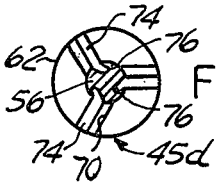
FIG. 7a
FIG. 7
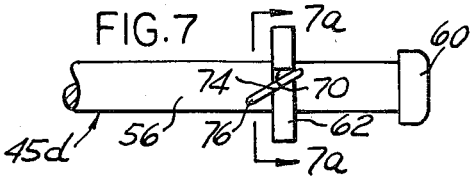
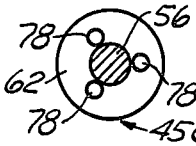
FIG. 8a
FIG. 8
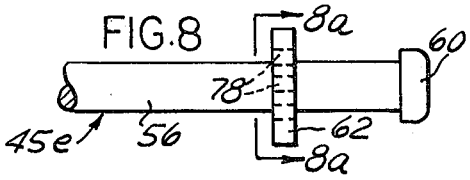
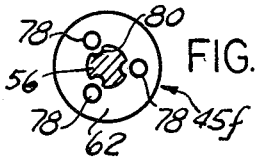
FIG. 9a
FIG. 9
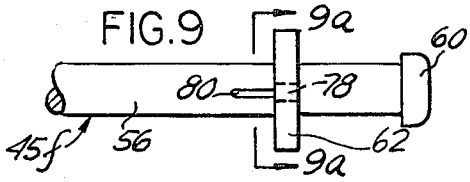
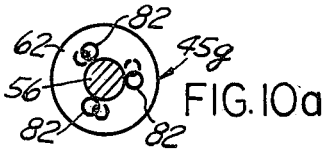
FIG. 10a
FIG. 10
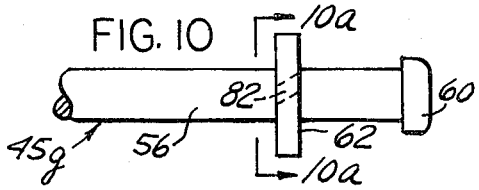
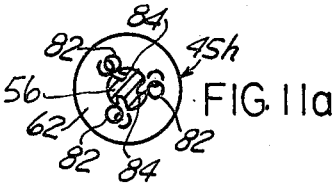
FIG. 11a
FIG. 11
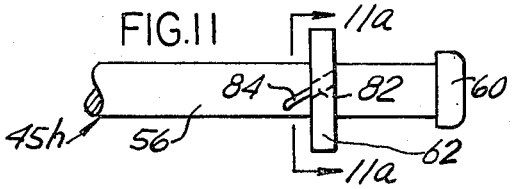

FIRING PIN

BACKGROUND OF THE INVENTION

Firearms are provided with a firing pin having an anvil end struck by the firearm hammer upon pulling of the trigger, when the firearm is fired. The other end of the firing pin is adapted to strike the rear of the cartridge, either at its center or proximate its edge, for firing the explosive charge in the cartridge and projecting the bullet through the firearm barrel. The firing pin has a shoulder abutment, proximate the anvil end, which limits the amount of forward motion of the firing pin upon striking of the anvil by the hammer.

In firearms designed for use with center-fire ammunition, the firing pin is in the form of a slender steel rod slidably disposed in a longitudinal bore formed in the firearm bolt. The firearm bolt is disposed in a longitudinal bore in a bolt-carrier and, generally, the assembly formed by the firing pin, the bolt and the bolt carrier is reciprocable relative to a stationary member of the firearm such as the receiver. In automatic firearms, or semi-automatic, reciprocation of the bolt and bolt-carrier in the receiver away from the firearm chamber accomplishes the functions of unlocking the bolt locking lugs from the barrel extension lugs, displacing the bolt and bolt-carrier rearwardly, and returning the hammer to the cocked position, while simultaneously extracting the cartridge of the spent round of ammunition from the chamber and ejecting the cartridge through an ejection port. The return of the bolt and bolt-carrier by the action of a return spring causes feeding of a fresh cartridge from the clip or magazine into the chamber. At the end of the stroke of the bolt-carrier, a pin and cam arrangement causes the bolt, after introducing its lugs through the lugs of the barrel extension, to rotate and lock the bolt in position, thus closing the chamber.

In gas-operated firearms, the rearward motion of the bolt-carrier in the receiver is effected by a mechanism actuated by the expansion of the gas propelling the bullet through the barrel, bypassed through a gas port disposed through the sidewall of the barrel. Some firearms are designed to permit this bled gas to expand in a cylinder between the bolt and the bolt-carrier, driving the bolt-carrier to the rear, unlocking the bolt, and causing the bolt and bolt-carrier to be propelled in a rearward direction, returning the hammer to the cocked position and compressing the bolt-carrier return spring. The compressed spring, when expanding, returns the bolt-carrier towards the chamber, picking up a fresh cartridge and locking the bolt in position in the chamber, as previously explained.

In such gas-operated firearms, considerable leakage of gas occurs between the peripheral surface of the bolt and the inner wall surface of the bolt-carrier where the rear extension of the bolt projects through the end of the bolt-carrier. The stream of leaking gas bathes the firing pin shoulder abutment and the peripheral surface of the firing pin stem between the shoulder abutment and the rear extension of the bolt. Carbon and other dirt particles are progressively deposited as a strongly adhering coating on the exposed surfaces of the firing pin, and more particularly on the peripheral surface of the stem proximate the shoulder abutment, on the lateral surface of the shoulder abutment directed toward the bolt rear extension and at the junction between the peripheral surface of the stem and the shoulder abutment lateral surface. Such carbon, and other residue, deposits may build up to the point that the firing pin becomes literally jammed or frozen in the end of the bolt bore, and/or to the point that the deposit on the lateral surface of the shoulder abutment becomes thick enough to prevent adequate stroke of the firing pin, upon hitting of its anvil end by the hammer, or sufficient force to be transmitted by the hammer to the firing pin, thus causing misfiring of the cartridge in the chamber.

The present invention provides a particular structure for firearm firing pins which remedies the inconveniences of the prior art, the particular firing pin structure of the invention preventing the accumulation of carbon or other dirt particles on the peripheral surface of the firing pin stem and shoulder abutment.

SUMMARY

The present invention accomplishes its purposes by providing a firing pin having apertures, in the form of slots or small bores through the shoulder abutment, defining an escape path for gas and dirt particles. By making such slots or small bores at an angle to the longitudinal axis of the firing pin in firearms wherein the bolt-carrier and bolt are operated by gas pressure, the action of the escaping gas flowing through the inclined slots or bores rotates the firing pin, thus tending to scrub away any film or particles deposits on the critical surfaces of the firing pin and shoulder abutment. The invention also contemplates cutting generally longitudinal grooves on the peripheral surfaces of the firing pin stem proximate the shoulder abutment, the edge of such grooves having a scrubbing action, more particularly in relation with the end of the bolt bore accepting the firing pin, such as to keep the surface in engagement with the grooves in a relatively clean state.

Although the present invention has particular advantages in gas-operated automatic and semi-automatic firearms, the principle of the invention can be adapted to firearms in which the bolt and/or bolt-carrier are manually operated, as it permits easy lubrication of the firing pin surface and prevents the deposit of dirt on the firing pin peripheral surface and on the surface of the wall of the cavity or bore accepting the firing pin.

The diverse objects and advantages of the present invention will become apparent to those skilled in the art when the following description of the best modes contemplated for practicing the invention is read in conjunction with the accompanying drawing wherein like reference numerals relate to like or equivalent parts and in which:

BRIEF DESCRIPTION OF THE DRAWING

FIG. 1 is a schematic illustration, generally in longitudinal section, of a gas-operated bolt and bolt-carrier for a firearm, showing the bolt in closed locked position;

FIG. 2 is a view similar to FIG. 1 but showing the bolt in an unlocked position;

FIG. 3 and 3*a* are, respectively, a longitudinal elevation view and a transverse section along line 3*a*—3*a* of FIG. 3, of the conventional prior art firing pin incorporated in the structure of FIGS. 1–2;

FIGS. 4–11 are longitudinal view and partial views of alternate modifications of firing pins according to the present invention; and FIGS. 4*a*–11*a* are transverse sections thereof, respectively along line 4*a*—4*a* of FIG. 4, line 5*a*—5*a* of FIG. 5, line 6*a*—6*a* of FIG. 6, line 7*a*—7*a* of FIG. 7, line 8*a*—

8*a*of FIG. 8, line 9*a*—9*a* of FIG. 9, line 10*a*—10*a* of FIG. 10 and line 11*a*—11*a* of FIG. 11.

DETAILED DESCRIPTION OF THE PREFERRED EMBODIMENTS

FIG. 1 schematically represents a longitudinal section through a bolt and bolt-carrier assembly 10 reciprocable in a firearm receiver 12. In order to simplify the disclosure, only the pertinent parts useful in explaining the present invention are illustrated at FIGS. 1 and 2, omitting the remaining of the firearm such as the barrel, stock assembly, sights, ammunition clip, trigger and hammer mechanism, which are not considered necessary for a clear understanding of the invention.

The bolt and bolt-carrier assembly 10, illustrated at FIGS. 1–2, is well known and is substantially like the bolt and bolt-carrier of conventional air-cooled, gas-operated semi-automatic rifles such as the AR-15 Sporter, manufactured by the Firearms Division of Colt Industries, of Hartford, Conn. The bolt and bolt-carrier assembly 10 is also similar to the assembly used in the military M-16 rifle.

The assembly 10 comprises the bolt-carrier 14 which is slidably supported in the receiver 12, and which is provided with a longitudinal bore 16 slidably accepting the bolt 18 through its open forward end. Proximate the rear end of the bore 16 in the bolt-carrier 14 there is integrally formed an end wall 20 having a centrally disposed bore 22. The bolt 18 has a forward end 24 provided with a plurality of lugs 26 engageable between corresponding lugs 28 projecting from the bore surface of the enlarged extension 30 of the barrel 32.

In the position illustrated at FIG. 1, the bolt-carrier 14 and the bolt 18 are in their forward extreme position, with the lugs 26 of the bolt engaged behind the lugs 28 of the barrel extension 30, the bolt 18 having been rotated such as to be locked in position, as a result of the rearward reciprocation of the bolt 18 relative to the bolt-carrier bore 16 which causes a transverse pin 34, radially passed through an helicoidal slot 36 in the wall of the bolt-carrier 14 and a radial bore 38 in the bolt 18 to rotate the bolt 18 around its longitudinal axis, the peripheral surface of the pin 34 riding on the helical surface of the slot 36. The bolt 18 has an integral piston member 40, formed proximate its rear end, having a peripheral groove in which are disposed sealing rings 42. The rearward end of the bolt 18 has a reduced diameter extension 44 slidably fitting through the bore 22 in the bolt carrier end wall 20. A firing pin 45 is slidably disposed in a longitudinal bore 47 in the bolt 18.

The bolt-carrier 14 is provided with a key 46 bolted to the top of the bolt carrier by means of a pair of socket screws 48. The key 46 has an integral tubular extension 49 placing an orifice 50 through the wall of the bolt-carrier 14 in communication with the end of a gas tube 52 leading to a gas exhaust port 53 through the wall of the gun barrel 32 proximate its forward end. When a cartridge 55 placed in the chamber 54 of the barrel 32 is fired by means of the firing pin, the bullet is propelled along the barrel, and as soon as it passes the gas exhaust port 53 in the barrel, gas under pressure is piped through the gas tube 52 in the tubular extension 49 of the key 46 to the orifice 50, thus introducing gas under pressure between the piston 40 of the bolt 18 and the end wall 20 of the bolt-carrier bore 16. As the bolt 18 cannot move forwardly, in the locked position illustrated at FIG. 1, the bolt-carrier 14 is reciprocated rearwardly in the course of the expansion of the gas in the chamber between the piston 42 and the end wall 20, as illustrated at FIG. 2, thus causing the bolt 18 to rotate and unlock as a result of its lugs 26 becoming aligned with the spaces between consecutive lugs 28 of the barrel extension bore, thus freeing the bolt and bolt-carrier assembly 14 for rearward motion which is continued by inertia. A pair of exhaust ports 57, normally covered by the piston 40, are uncovered, thus allowing pressure in the chamber between the piston 40 and the end wall 20 to be released to the ambient.

As shown at FIGS. 1 and 2 and also in details at FIGS. 3 and 3*a*, the firing pin 45 has a relatively slender stem 56, a relatively sharp end 58 for firing the cartridge and a blunt enlarged end forming an anvil 60 which is struck by the hammer, not shown, for firing the cartridge. Proximate the anvil 60, the firing pin 45 is provided with an integral shoulder abutment 62 limiting the forward motion of the firing pin when its anvil 60 is struck by the hammer, as the result of engaging the end face of the reduced diameter extension 44 of the bolt 18. The cam pin 34 is provided with a transverse aperture 64 permitting the stem 56 of the firing pin 45 to pass therethrough, and retaining means, such as a cotter pin 66 passed through the wall of the bolt-carrier 14, is used for retaining the firing pin 45 in position through interference with the other face of the shoulder abutment 62, while still providing sufficient clearance for limited reciprocation of the firing pin 45 in the bore 47 in the bolt 18.

Referring again to FIGS. 1–2, it is readily apparent that gas introduced through the port 50 into the chamber in the bolt-carrier bore 16 between the piston 40 and the end wall 20 leaks through the clearance between the surface of the bore 22 in the end wall 20 and the peripheral surface of the bolt reduced diameter extension 44. Consequently, each time the weapon is fired some minor amount of dirt, and more particularly of carbon-like deposit, is caused to adhere to the surface of the firing pin stem 56 proximate the shoulder abutment 62, and on the abutting face 67 of the shoulder abutment 62 directed towards the bore 22, such adhering coating being schematically shown at 68 at FIGS. 3 and 3*a*. The carbon and dirt deposit builds up in thickness until the firing pin stem 56 seizes in the end of the bore 47 in the bolt 18. In addition, the build-up on the face 67 of the firing pin shoulder abutment 62 prevents direct engagement of the shoulder abutment face 67 with the end face of the bolt extension 44, with the result that the firing pin 45, when its anvil end 60 is struck by the hammer, may be prevented from projecting forwardly sufficiently and with enough force to fire the cartridge. It has been found that misfiring of a round of ammunition may occur as early as after firing 60 to 80 rounds. The problem can be cured by disassembly of the rifle and stripping the bolt-carrier, bolt and firing pin, and removing from the firing pin stem and shoulder abutment surfaces the carbon and other dirt deposits. Misfiring and stripping of a military rifle under combat conditions presents obviously dire inconveniences.

The present invention remedies those disadvantages and inconveniences by providing an escape path for the leaking gas beyond the firing pin shoulder abutment 62, as illustrated at FIGS. 4–11*a*. At FIGS. 4–4*a*, the shoulder abutment 62 of the firing pin 45*a* is provided with a plurality of radial slots 70 extending from the periphery of the shoulder abutment 62 to flush with the peripheral surface of the stem 56. Three such slots 70 are illustrated, as it has been found that three slots provide adequate passageway area through the shoulder abutment 62, permitting the leaking gas to escape and preventing the undesired carbon or dirt deposit to form.

FIGS. 5–5*a* illustrates a modification wherein in addition to the radial slots 70 formed in the shoulder abutment 62 of the firing pin 45*b*, corresponding shallow longitudinal grooves 72 are cut in the peripheral surface of the firing pin stem 56. The grooves 72 provide additional passageway area for the escaping leaking gas and the edge of the grooves 72 act as a scrubber for the internal surface of the bore 47 through the bolt 18 (FIGS. 1 and 2) at the end of the bore corresponding to the bolt rear extension 44.

FIGS. 6–6*a* illustrate a further modified firing pin 45*c* wherein the radial slots 70 through the pin shoulder abutment 62 are disposed at an angle to the longitudinal axis of the firing pin or, preferably and as shown at 74, one of the side walls of the slots 70 is disposed at an angle to the longitudinal axis of the firing pin. Providing the shoulder abutment 62 of the firing pin 45*c* with slots having an angled side wall 74 has been found to cause the firing pin to rotate when the high velocity leaking gas flows through the slots. At FIG. 7–7*a*, the angled sidewall 74 of the slots 70 through the shoulder abutment 62 of the firing pin 45*d* are combined with helical grooves 76 formed on the peripheral surface of the stem 56. Although straight grooves could be used, as the straight grooves 72 illustrated at FIGS. 5–5*a*, helical grooves have a better scrubbing action in the bore of the bolt.

FIGS. 8–8*a* illustrate a further embodiment of the invention wherein an escape path for the leaking gas takes the form of a plurality of apertures in the form of longitudinal bores 78 leading from one face of the shoulder abutment 62 of the firing pin 45*e* to the other face. At FIGS. 9–9*a*, a modification is illustrated wherein, in addition to the longitudinal bores 78 through the shoulder abutment 62, the stem 56 of the firing pin 45*f* is also provided with longitudinal grooves 80. FIGS. 10–10*a* illustrate a firing pin 45*g* whose shoulder abutment 62 is provided with a plurality of bores 82 formed at an angle to the longitudinal axis of the firing pin, such that the passage of high velocity leaking gas through the angled bores 82 applies a torque to the firing pin which rotates it every time the firearm is fired. FIGS. 11–11*a* illustrates a further modification in which, in addition of angled bores 82 being provided through the shoulder abutment 62 of the firing pin 45*h*, the firing pin 45*h* has helical grooves 84 cut in the stem 56.

It will be appreciated that although exemplary structures of firing pins have been described and illustrated, the principles of the invention are applicable to diverse firing pin structures other than those specifically illustrated and described. It will also be appreciated that firing pins used in other types of gas-operated semi-automatic and automatic firearms, and firing pins for firearms provided with manual ammunition feed, may be made according to the invention, as the structure of the invention prevents the accumulation of dirt on the stem of firing pins and on the surface of firing pin shoulder abutments.

It will be apparent to those skilled in the art that the diverse embodiments of the invention have been shown and described for illustrative purpose only and that many changes, modifications and substitutions may be made without necessarily departing from the spirit and scope of the invention.

I claim:

1. In a firearm having a gas-operated bolt mechanism and a firing pin having a stem provided with a cylindrical peripheral surface slidably disposed in a longitudinal cylindrical bore in said bolt mechanism, said stem being provided with an integral shoulder abutment having a face engageable with an end of said bore for limiting the stroke of said firing pin in said bore in a direction causing firing of a bullet cartridge, and wherein gas is introduced in said bolt mechanism and said gas leaking through said bore between said bore and said stem causes a deposit to be formed on said stem peripheral surface proximate said shoulder abutment and on said face of said shoulder, the improvement comprising means for causing said firing pin to rotate, said means being at least one passageway through said shoulder abutment forming a gas escape path from a face to the other face of said shoulder abutment, said passageway being disposed adjoining said stem peripheral surface.

2. The improvement of claim 1 wherein said passageway is a radial slot in said shoulder abutment.

3. The improvement of claim 2 further comprising a longitudinal groove in the surface of the stem of said firing pin proximate said shoulder abutment and substantially aligned with said slot.

4. The improvement of claim 1 wherein said passageway is a bore.

5. The improvement of claim 4 further comprising at least one groove formed in the peripheral surface of the stem of said firing pin and substantially aligned with said bore.

6. In a firearm having a gas-operated bolt mechanism and a firing pin having a stem provided with a cylindrical peripheral surface slidably disposed in a longitudinal cylindrical bore in said bolt mechanism, said stem being provided with an integral shoulder abutment having a face engageable with an end of said bore for limiting the stroke of said firing pin in said bore in a direction causing firing of a bullet cartridge, and wherein gas is introduced in said bolt mechanism and said gas leaking through said bore between said bore and said stem causes a deposit to be formed on said stem peripheral surface proximate said shoulder abutment and on said face of said shoulder, the improvement comprising means for causing said firing pin to rotate, said means being at least one passageway through said shoulder abutment forming a gas escape path from a face to the other face of said shoulder abutment, said passageway being disposed adjoining said stem peripheral surface, and at least one groove formed in the peripheral surface of the stem of said firing pin proximate said shoulder abutment.

7. The improvement of claim 6 wherein said passageway is a radial slot in said shoulder abutment.

8. The improvement of claim 7 wherein said slot has at least one sidewall at an angle to the longitudinal axis of said firing pin.

9. The improvement of claim 6 wherein said passageway is a bore.

10. The improvement of claim 9 wherein said bore has an axis disposed at an angle to the longitudinal axis of said firing pin.

11. The improvement of claim 7 further comprising a longitudinal groove in the surface of the stem of said firing pin proximate said shoulder abutment and substantially aligned with said slot.

12. The improvement of claim 8 further comprising at least one helical groove in the peripheral surface of the stem of said firing pin substantially aligned with said angled slot sidewall.

13. In a firearm having a bolt mechanism and a firing pin having a stem slidably disposed in a longitudinal bore in said bolt mechanism, said stem being provided with a shoulder abutment engageable with an end of said bore for limiting the stroke of said firing pin in said bore in a direction causing firing of a bullet cartridge, the improvement comprising at least one radial slot through said shoulder abutment forming a gas escape path from a face to the other face of said shoulder abutment, said radial slot being disposed adjoining said stem and having at least one sidewall at an angle to the longitudinal axis of said firing pin stem, and at least one helical groove in the peripheral surface of the stem of said firing pin disposed substantially at the same angle to the longitudinal axis of said firing pin as the angle of said slot sidewall.

14. In a firearm having a bolt mechanism and a firing pin having a stem slidably disposed in a longitudinal bore in said bolt mechanism, said stem being provided with a shoulder abutment engageable with an end of said bore for limiting the stroke of said firing pin in said bore in a direction causing firing of a bullet cartridge, the improvement comprising at least one bore through said shoulder abutment forming a gas escape path from a face to the other face of said shoulder abutment, said bore being disposed adjoining said stem and having an axis disposed at an angle to the longitudinal axis of said firing pin stem, and at least one helical groove in the peripheral surface of the stem of said firing pin disposed substantially at the same angle to the longitudinal axis of said firing pin as the angle of said slot sidewall.

15. In a firearm having a bolt mechanism and a firing pin slidably disposed in a longitudinal bore in said bolt mechanism, said firing pin having a stem provided with a shoulder abutment limiting the stroke of said firing pin in said bore in a direction causing firing of a bullet cartridge, the improvement comprising at least one radial slot formed in said shoulder abutment, said slot having at least one sidewall at an angle to the longitudinal axis of said firing pin, and at least one groove in the peripheral surface of the stem of said firing pin substantially aligned with said slot, wherein said groove is helical and is disposed substantially at the same angle to the longitudinal axis of said firing pin as the angle of said slot sidewall.

16. The improvement of claim 15 wherein said groove is helical and is disposed substantially at the same angle to the longitudinal axis of said firing pin as the angle of said slot sidewall.

17. In a firearm having a bolt mechanism and a firing pin slidably disposed in a longitudinal bore in said bolt mechanism, said firing pin having a stem provided with a shoulder abutment limiting the stroke of said firing pin in said bore in a direction causing firing of a bullet cartridge, the improvement comprising at least one bore formed in said shoulder abutment, said bore having an axis disposed at an angle to the longitudinal axis of said firing pin, and a groove in the peripheral surface of the stem of said firing pin substantially aligned with said bore, wherein said groove is helical and is disposed substantially at the same angle to the longitudinal axis of said firing pin as the angle of said bore in said shoulder abutment.

18. The improvement of claim 17 wherein said groove is helical and is disposed substantially at the same angle to the longitudinal axis of said firing pin as the angle of said bore in said shoulder abutment.

* * * * *